US007135670B2

(12) United States Patent
Shimoi et al.

(10) Patent No.: US 7,135,670 B2
(45) Date of Patent: Nov. 14, 2006

(54) PHOTOMULTIPLIER AND RADIATION DETECTOR

(75) Inventors: Hideki Shimoi, Hamamatsu (JP); Hiroyuki Kyushima, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 11/189,023

(22) Filed: Jul. 26, 2005

(65) Prior Publication Data

US 2006/0091317 A1 May 4, 2006

(30) Foreign Application Priority Data

Oct. 29, 2004 (JP) ..... P2004-316552

(51) Int. Cl.
*H01J 21/20* (2006.01)
*H01J 43/04* (2006.01)

(52) U.S. Cl. ..... 250/214 VT; 250/207; 313/103 R; 313/532

(58) Field of Classification Search ..... 250/207, 250/214 VT, 370.11, 370.08; 315/11, 12.1, 315/523–544, 103, 103 CM, 104, 105 R, 315/105 CM, 103 R
See application file for complete search history.

(56) References Cited

U.S. PATENT DOCUMENTS 5,498,926 A * 3/1996 Kyushima et al. ..... 313/533
5,504,386 A * 4/1996 Kyushima et al. ..... 313/103 R
5,864,207 A * 1/1999 Kume et al. ..... 313/533
6,472,664 B1 * 10/2002 Kyushima et al. ..... 250/366
2003/0102802 A1 * 6/2003 Kyushima et al. ..... 313/533

FOREIGN PATENT DOCUMENTS

JP 05-290793 A 11/1993
JP 2002-203508 7/2002

* cited by examiner

*Primary Examiner*—Stephone B. Allen
*Assistant Examiner*—Davienne Monbleau
(74) *Attorney, Agent, or Firm*—Drinker Biddle & Reath LLP

(57) ABSTRACT

Onto a base member, through which stem pins are passed and holding members are to be joined to the respective surfaces thereof, the stem pins and the holding members are joined by fusion by melting of the base member to arrange a stem with at least three or more layers formed by sandwiching the base member by the holding members. In comparison to a conventional arrangement wherein the stem is arranged as a single layer of glass material and this is melted to fuse the stem pins, the positional precision, flatness, and levelness of both surfaces of the stem are improved.

6 Claims, 16 Drawing Sheets

(a)

(b)

(a)

(b)

PHOTOMULTIPLIER AND RADIATION DETECTOR

BACKGROUND OF THE INVENTION

1. Field of the Invention

This invention concerns a photomultiplier that makes use of the photoelectric effect and a radiation detector that uses this photomultiplier.

2. Related Background of the Invention

As one type of photomultiplier, a so-called head-on photomultiplier is known. With this head-on photomultiplier, a sealed vacuum container is arranged by providing a light receiving plate at an end portion at one side of a cylindrical side tube and providing a stem at an end portion at the other side of the side tube, and a photoelectric surface is disposed on the inner surface of the light receiving plate. An arrangement is provided wherein an electron multiplier unit, with a plurality of stages of dynodes, and an anode are layered and positioned opposite the photoelectric surface, and a plurality of stem pins, respectively connected to the respective dynodes and the anode, are insertedly mounted in the stem so as to lead to the exterior from inside the sealed container. Incident light that is made incident through the light receiving plate is converted into electrons at the photoelectric surface, the electrons that are emitted from the photoelectric surface are successively multiplied at the electron multiplier unit, wherein predetermined voltages are applied via the respective stem pins to the respective diodes, and the electrons that reach the anode upon being multiplied are taken out as an electrical signal via an anode pin, which is one of the stem pins.

Among such photomultipliers, there is an arrangement, wherein the stem pins are respectively mounted insertedly in a metal stem via tapered hermetic glass and the anode and the electron multiplier unit are layered above the plurality of stem pins, and an arrangement, wherein the stem pins are directly mounted insertedly in a stem formed of a large, tapered hermetic glass and the anode and the electron multiplier unit are layered on this stem (see, for example, FIG. 1 and FIG. 7 of Japanese Published Unexamined Patent Application No. Hei. 5-290793).

SUMMARY OF THE INVENTION

The former arrangement (the arrangement illustrated in FIG. 1 of Japanese Published Unexamined Patent Application No. Hei 5-290793) requires hermetic glass of a number corresponding to the number of stem pins and a step of setting each of these portions at a stem pin insertion position along with each stem pin. The number of parts and the number of manufacturing steps are thus large, and furthermore, since the anode and the electron multiplier unit are layered above the plurality of stem pins, the resistance against vibration is low and, for example, the hermetic glass becomes chipped due to mechanical stress applied to the stem pins.

Meanwhile, with the latter arrangement (the arrangement illustrated in FIG. 7 of Japanese Published Unexamined Patent Application No. Hei 5-290793), the respective stem pins are insertedly mounted in a single tapered hermetic glass that serves as the stem, and the anode and the electron multiplier unit are layered on this tapered hermetic glass. Though improvements are thus made in regard to the issues of the former arrangement, since the tapered hermetic glass and the respective stem pins are generally joined by fusing by the melting of the hermetic glass, the respective surfaces (the upper and lower surfaces in the figure) of the stem formed of hermetic glass are low in positional precision, flatness, and levelness and thus give rise to the following issues.

That is, due to the lowering of the positional precision, flatness, and levelness of the inner surface (upper surface) of the stem, the positional precision of the interval between the electron multiplier unit, which is installed on the inner surface of the stem, and the photoelectric surface is degraded, causing degradation of characteristics and lowering of the seating property of the electron multiplier unit. Meanwhile, due to the lowering of the positional precision, flatness, and levelness of the outer surface (lower surface) of the stem, the dimensional precision of the total length of the photomultiplier is degraded and the mounting property regarding surface mounting of the photomultiplier, for example, onto a circuit board, etc., is degraded.

This invention has been made to resolve such issues, and an object thereof is to provide a photomultiplier, with which the positional precision of the interval between a photoelectric surface and an electron multiplier unit is improved to enable predetermined characteristics to be obtained and with which the seating property of the electron multiplier unit, the dimensional precision of the total length of the photomultiplier, and the mounting property regarding surface mounting of the photomultiplier are improved, and a radiation detector equipped with such a photomultiplier.

A photomultiplier according to this invention comprises: a photoelectric surface, disposed inside a sealed container, which is put in a vacuum state, and converting incident light made incident through a light receiving plate into electrons, which forms an end portion at one side of the sealed container; an electron multiplier unit, disposed inside the sealed container and multiplying electrons emitted from the photoelectric surface; an anode, disposed inside the sealed container and used for taking out the electrons multiplied by the electron multiplier unit as an output signal; a stem, forming an end portion at the other side of the sealed container and having a base member, with an insulating property, and holding members, having a melting point higher than that of the above-mentioned base member and being joined respectively to an inner surface and an outer surface of the above-mentioned base member; and a plurality of stem pins, insertedly mounted in the stem and leading to the exterior from inside the sealed container and electrically connected to the anode and the electron multiplier unit; with the stem pins being passed through and joined to the base member, the electron multiplier unit and the anode being layered on the inner surface of the stem, and the base member and the holding members, and the base member and the stem pins being respectively joined by fusion by the melting of the base member.

With this photomultiplier, since the base member, through and to which the stem pins are passed and fixed, is joined to the stem pins and the holding members by fusion by the melting of the base member and the stem thus has an arrangement of at least three or more layers formed by the sandwiching of the base member by the holding members, the positional precision, flatness, and levelness of both surfaces of the stem are improved in comparison to the conventional arrangement wherein the stem is arranged as a single layer of glass material that is melted for fusion with the stem pins. As a result, the positional precision of the interval between the electron multiplier unit, which is installed on the inner surface of the stem, and the photoelectric surface is improved to enable predetermined characteristics to be obtained, and the seating property of the electron multiplier unit, the dimensional precision of the total length of the photomultiplier, and the mounting property regarding surface mounting of the photomultiplier are improved as well.

Here, each holding member may have a plurality of openings, through which the stem pins joined to the base member are inserted, and at least two of these openings may be made larger in diameter than the other openings. With this arrangement, the entry of positioning jigs into the openings is enabled, thus facilitating the positioning of the base member and the holding members and enabling the lowering of the manufacturing cost. Also, since openings, through which the stem pins are inserted, are made large in diameter and the positioning jigs are made to enter these openings for positioning of the base member and the holding members, the concentricities of the stem pins and the openings of the holding members are secured. In the case where a stem of four layers or more is arranged by joining other members to the holding members, these other members may be provided, as with the holding members, with openings, through which the stem pins joined to the base member are inserted, and at least two of these openings may be made larger in diameter than the other openings.

At least one of the holding members may be provided with a base member seep opening, into which the base member seeps upon melting. With this arrangement, since, upon melting, a volume of the base member escapes satisfactorily into the base member seep opening, both surfaces of the stem are improved further in positional precision, flatness, and levelness.

Here, with the conventional arrangement, wherein the stem pins are insertedly mounted in tapered hermetic glass, since the peripheries of the portions at which the tapered hermetic glass is joined to the stem pins become bulged portions of acute angles, cracks are formed in the tapered hermetic glass when a bending force acts on the stem pins, thus leading to a functional defect as well as an appearance defect of the sealed container. Also, when triple junctions are positioned at positions where the junctions are bare, the voltage endurance degrades.

The stem may thus be arranged so that the full circumferences of the stem pin passing portions of the inner surface and the outer surface have recesses having the base member as the bottom surfaces.

When such an arrangement is employed, the peripheries of the portions at which the base member is joined to the stem pins become the bottom surfaces of the recesses formed in the stem so that the base member is joined to the stem pins at gradual angles (angles that are gradual in comparison to the above-mentioned acute angles), and since even when a bending force acts on the stem pins, the stem pins will contact the peripheral portions at the open sides of the recesses and this will prevent further bending of the stem pins, cracks are prevented from being formed at both sides of the stem pin joining portions of the base member, and airtightness and good appearance of the sealed container are thus secured. Also, since the triple junctions, at which a conductive stem pin, the insulating base member to which the stem pin is joined, and vacuum intersect, are positioned inside the recesses and are thus put in concealed-like states, the predetermined voltage endurance is secured.

An arrangement having a side tube, which is conductive, forms the sealed container, and surrounds the stem from the side, and wherein members of the stem at the inner side with respect to the base member have an insulating property is also possible. When such an arrangement is employed, since the triple junctions are positioned in recesses as described above, the creeping distances from the side tube to the triple junctions are made long in comparison to the case where the triple junctions exist at positions where the junctions are bare, and the predetermined voltage endurance is thus secured further.

Here, by installing a scintillator, which converts radiation into light and emits the light, at the outer side of the light receiving plate of the above-described photomultiplier, a favorable radiation detector that exhibits the above-mentioned actions is provided.

DESCRIPTION OF THE PREFERRED EMBODIMENTS

Figure 1:
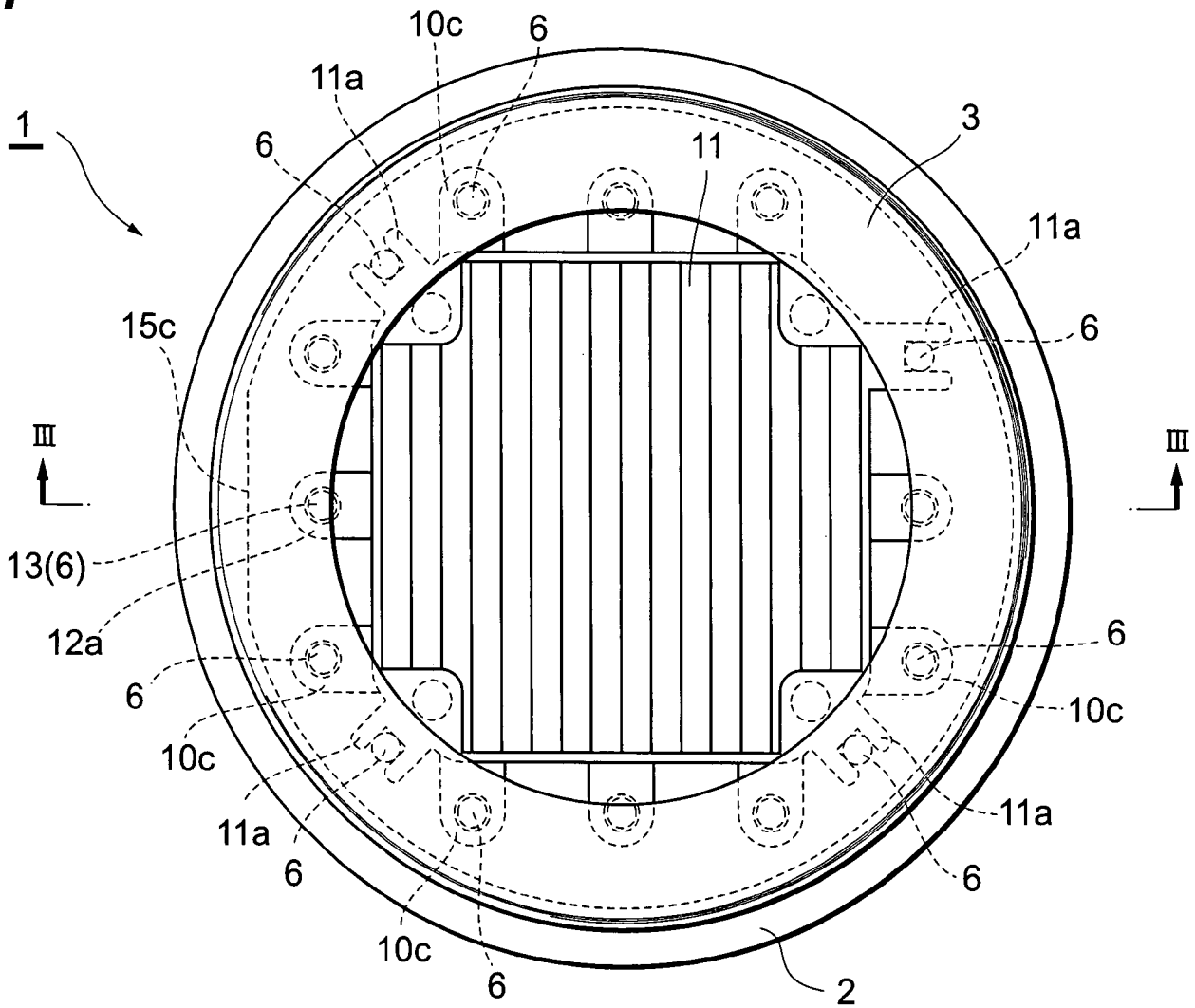
FIG. 1 is a plan view of an embodiment of a photomultiplier by this invention.

Preferred embodiments of this invention's photomultiplier and radiation detector shall now be described with reference to the drawings. The terms, "upper," "lower," etc., in the following description are descriptive terms based on the states illustrated in the drawings. In the drawings, portions that are the same or correspond to each other are provided with the same symbol and overlapping description shall be omitted.

Figure 2:
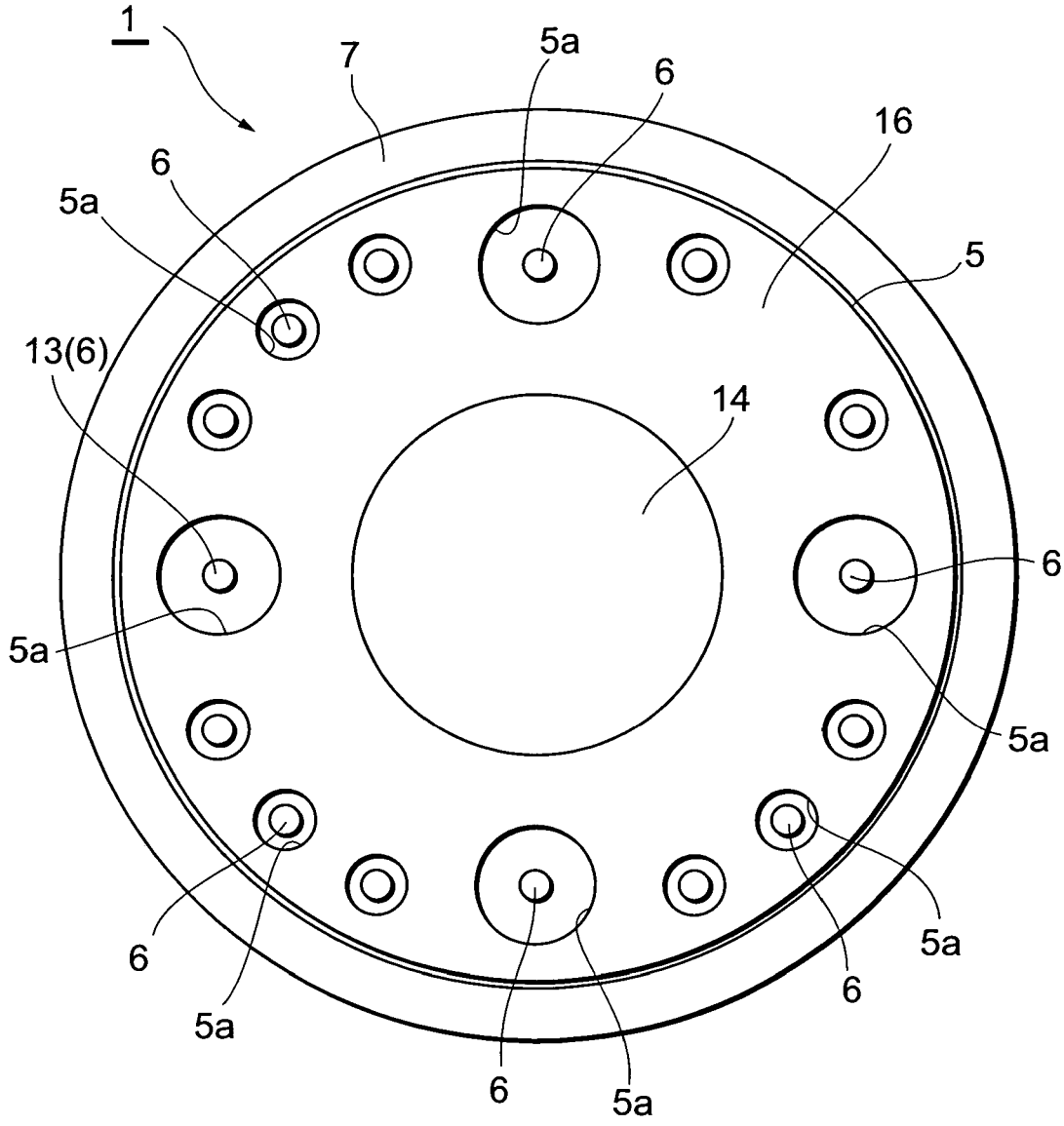
FIG. 2 is a bottom view of the photomultiplier shown in FIG. 1.
Figure 3:
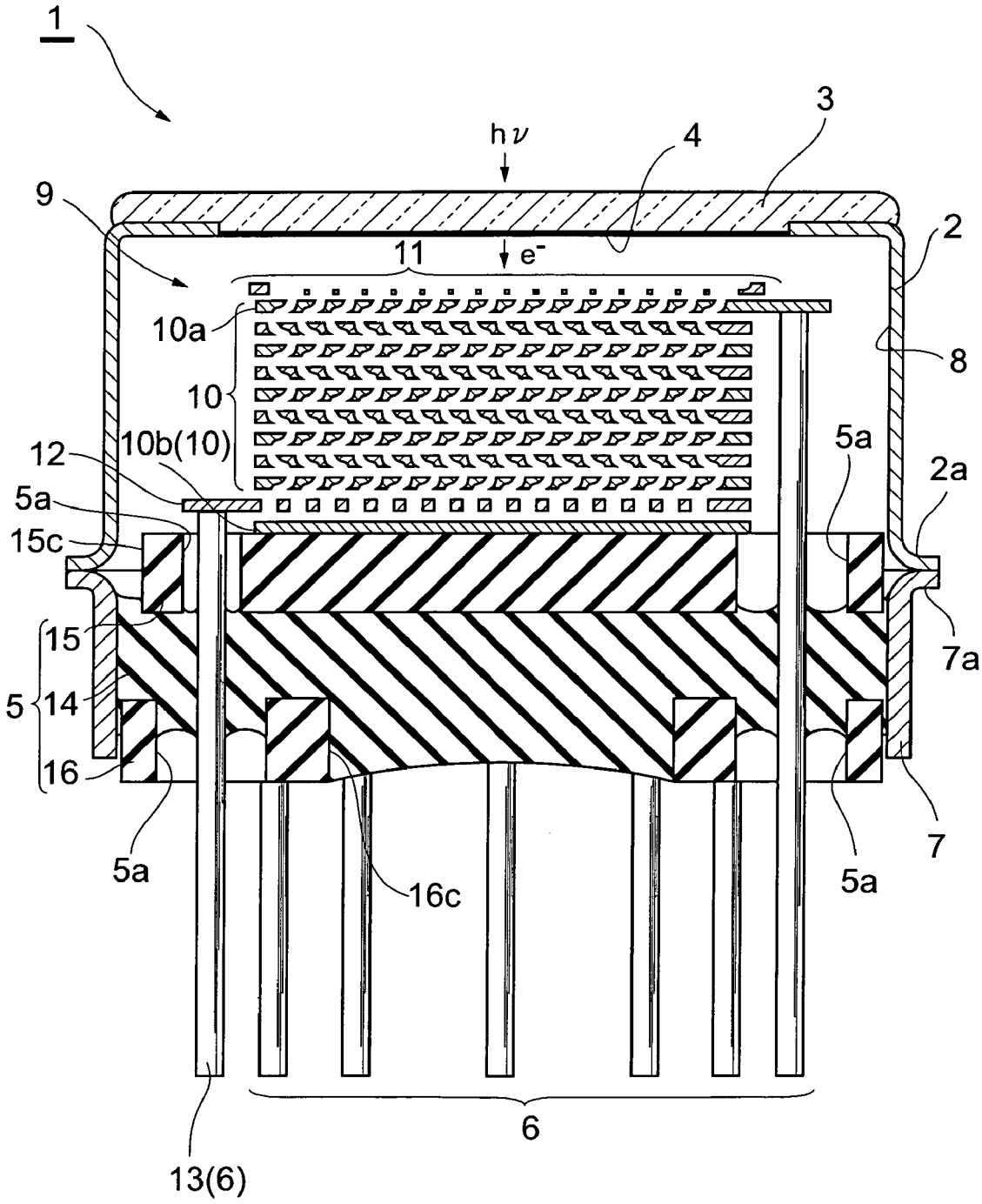
FIG. 3 is a sectional view taken along line III—III of the photomultiplier shown in FIG. 1.

FIG. 1 and FIG. 2 are a plan view and a bottom view, respectively, of an embodiment of a photomultiplier by this invention, and FIG. 3 is a sectional view taken along line III—III in FIG. 1. In FIG. 1 to FIG. 3, a photomultiplier 1 is arranged as a device that emits electrons upon incidence of light from the exterior and multiplies and outputs the electrons as a signal.

As shown in FIG. 1 to FIG. 3, the photomultiplier 1 has a metal side tube 2 with a substantially cylindrical shape. As shown in FIG. 3, a glass light receiving plate 3 is fixed in an airtight manner to an open end at the upper side (one side) of the side tube 2, and a photoelectric surface 4, for converting the light made incident through the light receiving plate 3 into electrons, is formed on the inner surface of the light receiving plate 3. Also, a disk-like stem 5 is positioned at an open end at the lower side (other side) of the side tube 2 as shown in FIG. 2 and FIG. 3. A plurality (15) of conductive stem pins 6, which are positioned apart from each other in the circumferential direction at positions substantially along a circle, are insertedly mounted in an airtight manner in the stem 5, and a metal, ring-like side tube 7 is fixed in an airtight manner so as to surround the stem 5 from the side. As shown in FIG. 3, a flange portion 2*a*, formed at a lower end portion of the upper side tube 2, and a flange portion 7*a* of the same diameter, formed at the lower ring-like side tube 7, are welded together, and by the side tube 2 and the ring-like side tube 7 being thereby fixed in an airtight manner, a sealed container 8, the interior of which is kept in a vacuum state, is formed.

Inside the sealed container 8, which is formed thus, is housed an electron multiplier unit 9 for multiplying the electrons emitted from the photoelectric surface 4. With this electron multiplying portion 9, a plurality of stages (ten in the present embodiment) of thin, plate-like dynodes 10, each having a plurality of electron multiplying holes, are laminated and formed as a block and installed on the upper surface of the stem 5. As shown in FIG. 1 and FIG. 3, at a predetermined peripheral portion of each dynode 10 is formed a dynode connecting tab 10*c*, which protrudes to the exterior, and a tip portion of a predetermined stem pin 6, insertedly mounted in the stem 5, is fixed by welding to the lower surface side of each dynode connecting tab 10*c*. The respective dynodes 10 are thus electrically connected respectively to the stem pins 6.

Furthermore, inside the sealed container 8, a plate-like focusing electrode 11, for converging and guiding the electrons emitted from the photoelectric surface 4 to the electron multiplier unit 9, is formed between the electron multiplier unit 9 and the photoelectric surface 4, and a plate-like anode 12, for taking out the electrons, multiplied by the electron multiplier unit 9 and emitted from the dynode 10*b* of the final stage, as an output signal, is layered at the stage one stage above the dynode 10*b* of the final stage as shown in FIG. 3. As shown in FIG. 1, protruding tabs 11*a*, which protrude outward, are formed respectively at the four corners of the focusing electrode 11, and by the predetermined stem pins 6 being fixed by welding to the respective protruding tabs 11*a*, the stem pins 6 are electrically connected to the focusing electrode 11. Also, an anode connecting tab 12*a*, which protrudes outward, is formed at a predetermined peripheral portion of the anode 12, and by an anode pin 13, which is one of the stem pins 6, being fixed by welding to the anode connecting tab 12*a*, the anode pin 13 is electrically connected to the anode 12. And when predetermined voltages are applied to the electron multiplier unit 9 and the anode 12 by means of the stem pins 6 connected to an unillustrated power supply circuit, the photoelectric surface 4 and the focusing electrode 11 are set to the same potential and the potentials of the respective dynodes 10 are set so as to increase in the order of layering from the upper stage to the lower stage. The anode 12 is set to a higher potential than the dynode 10*b* of the final stage. Though in the present embodiment, the final dynode 10*b* is directly set and fixed on the upper surface of the stem 5, an arrangement, wherein the final dynode 10*b* is supported, for example, by a supporting member installed on the upper surface of the stem 5 and a space is interposed between final dynode 10*b* and the upper surface of the stem 5, is also possible.

With the photomultiplier 1, arranged as described above, when light (hv) is made incident on the photoelectric surface 4 from the light receiving plate 3 side, the light at the photoelectric surface 4 is photoelectrically converted and electrons (e−) are emitted into the sealed container 8. The emitted electrons are focused by the focusing electrode 11 onto the first dynode 10*a* of the electron multiplier unit 9. The electrons are then multiplied successively inside the electron multiplier unit 9 and a set of secondary electrons are emitted from final dynode 10*b*. This group of secondary electrons is guided to the anode 12 and output to the exterior via the anode pin 13, which is connected to the anode 12.

The arrangement of the above-mentioned stem 5 shall now be described in further detail. Here, with the stem 5, the side, which is to be put in a vacuum state upon forming of the sealed container 8 of photomultiplier, shall be referred to as the "inner side" (upper side).

As shown in FIG. 3, the stem 5 has a three-layer structure formed of a base member 14, an upper holding member 15, which is joined to the upper side (inner side) of the base member 14, and a lower holding member 16, which is joined to the lower side (outer side) of the base member 14, and the above-mentioned ring-like side tube 7 is fixed to the side surface of this structure. In the present embodiment, the stem 5 is fixed to the ring-like side tube 7 by joining the side surface of the base member 14, which makes up the stem 5, to the inner wall surface of the ring-like side tube 7. Here, although the lower (outer) surface of the lower holding member 16 protrudes below the lower end of the ring-like side tube 7, the position of fixing of the stem 5 with respect to the ring-like side tube 7 is not restricted to that described above.

Figure 4:
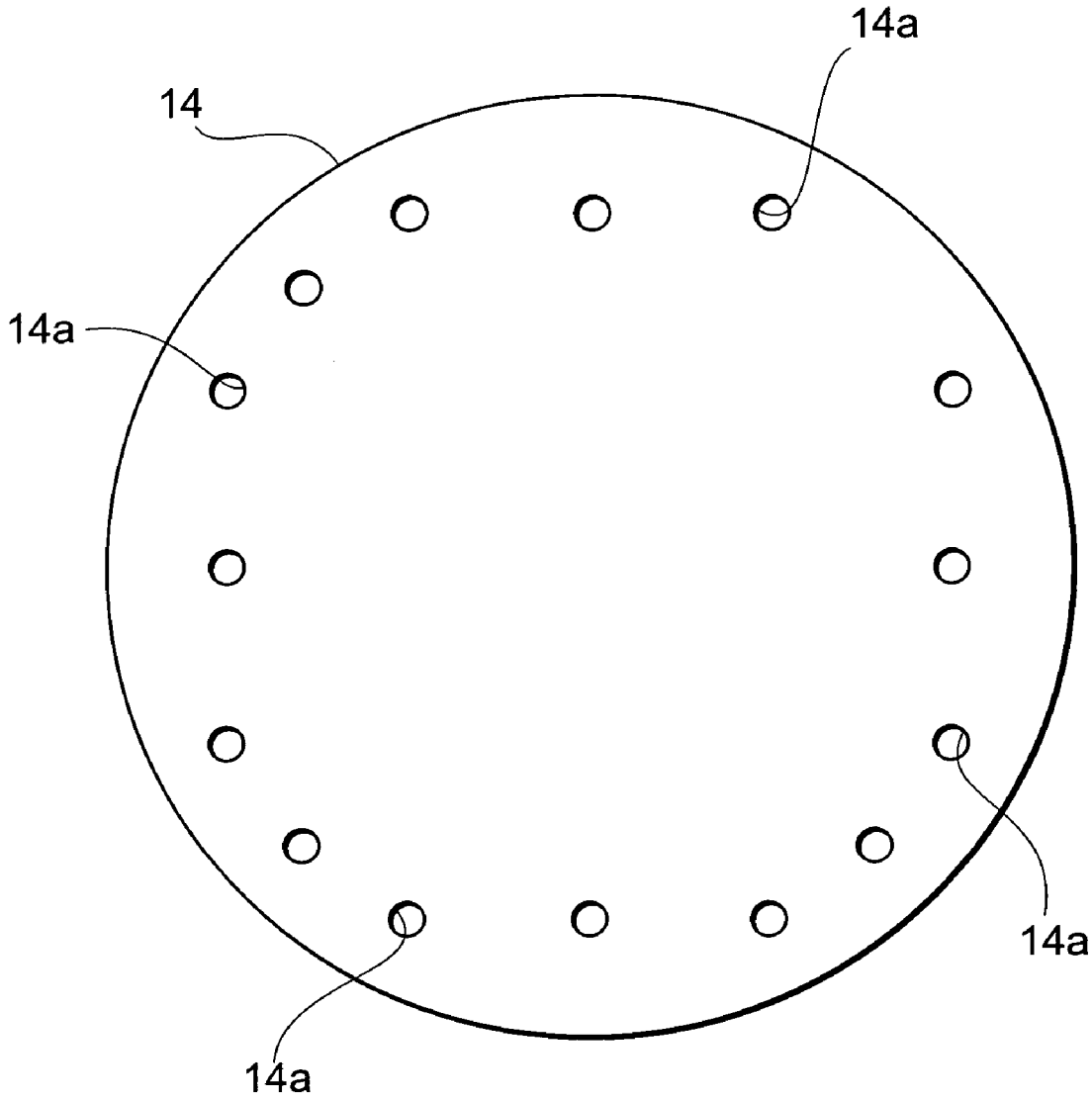
FIG. 4 is a plan view of a base member.

The base member 14 is a disk-like member formed of an insulating glass having, for example, covar as the main component and having a melting point of approximately 780 degrees, and is made black in color to a degree to which light will not be transmitted into the sealed container 8 from the lower surface. Also as shown in FIG. 4, a plurality (15) of openings 14*a*, of substantially the same diameter as the outer diameter of the stem pins 6, are formed in the base member 14 so as to be aligned along the outer circumferential portion of the base member 14.

Figure 5:
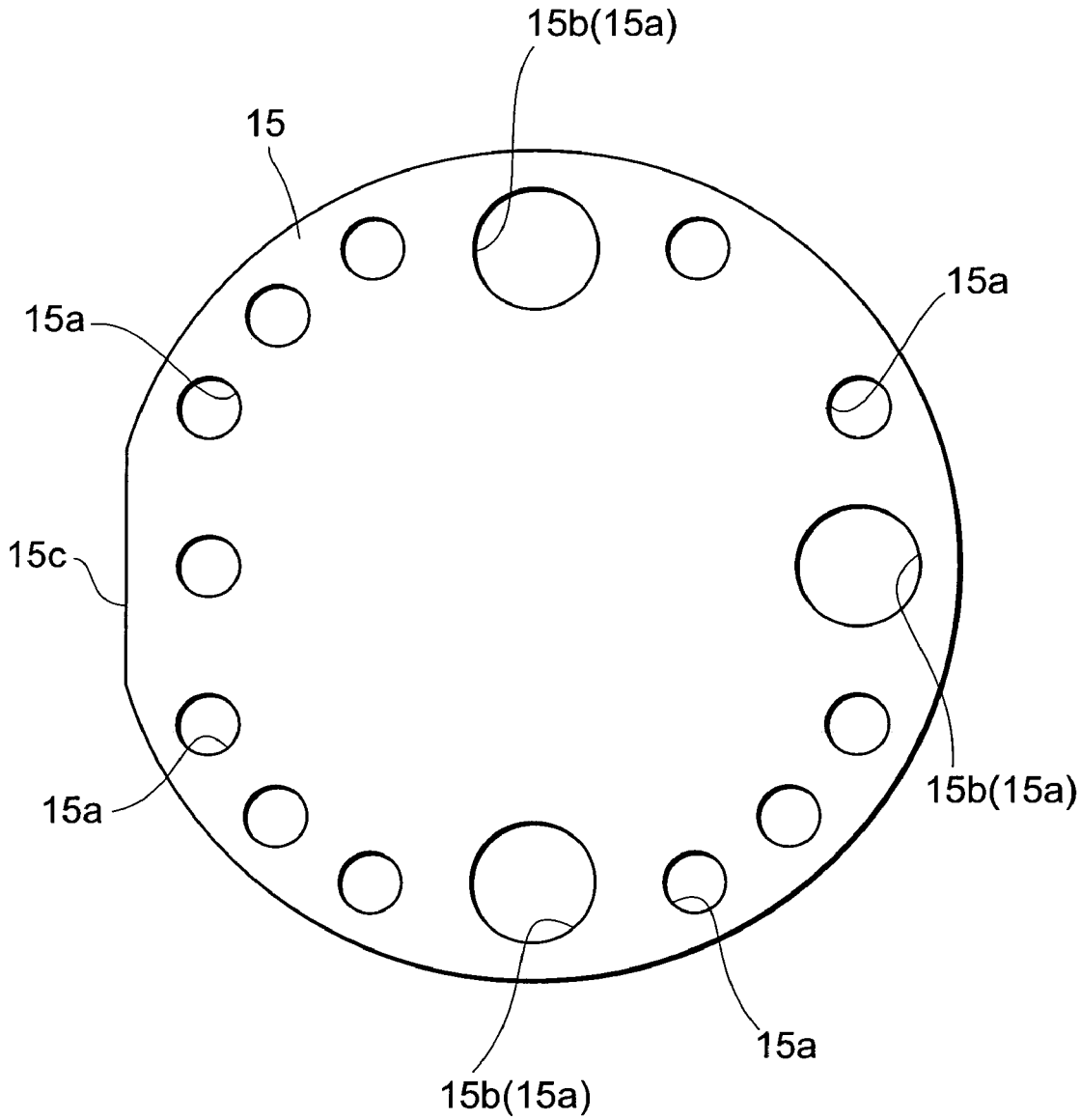
FIG. 5 is a plan view of an upper holding member.

The upper holding member 15 is a disk-like member, formed of insulating glass that has been made to have a higher melting point than the base member 14, that is for example, a melting point of approximately 1100 degrees by, for example, the addition of an alumina-based powder to covar, and is made black in color in order to effectively absorb light emitted inside the sealed container 8. Also as shown in FIG. 5, the upper holding member 15 has a plurality (15) of the openings 15*a*, positioned in the same manner as those of the base member 14. Each opening 15*a* is made larger in diameter than the openings 14*a* formed in the base member 14, and furthermore, among the openings 15*a*, the openings of at least two predetermined locations are arranged as large-diameter openings 15*b*, which are made even larger in diameter than the other openings 15*a* in order to enable the entry of a positioning jig 18 (to be described later) into the base member 14. In the upper holding member 15, the large-diameter openings 15*b* are positioned at three locations, other than the location of the opening 15*a* into which the anode pin 13 is inserted, which are separated by a phase angle of 90 degrees. Also with the upper holding member 15, a peripheral portion near the opening 15*a*, through which the anode pin 13 is inserted, is made as the chamfered shape 15*c*.

Figure 6:
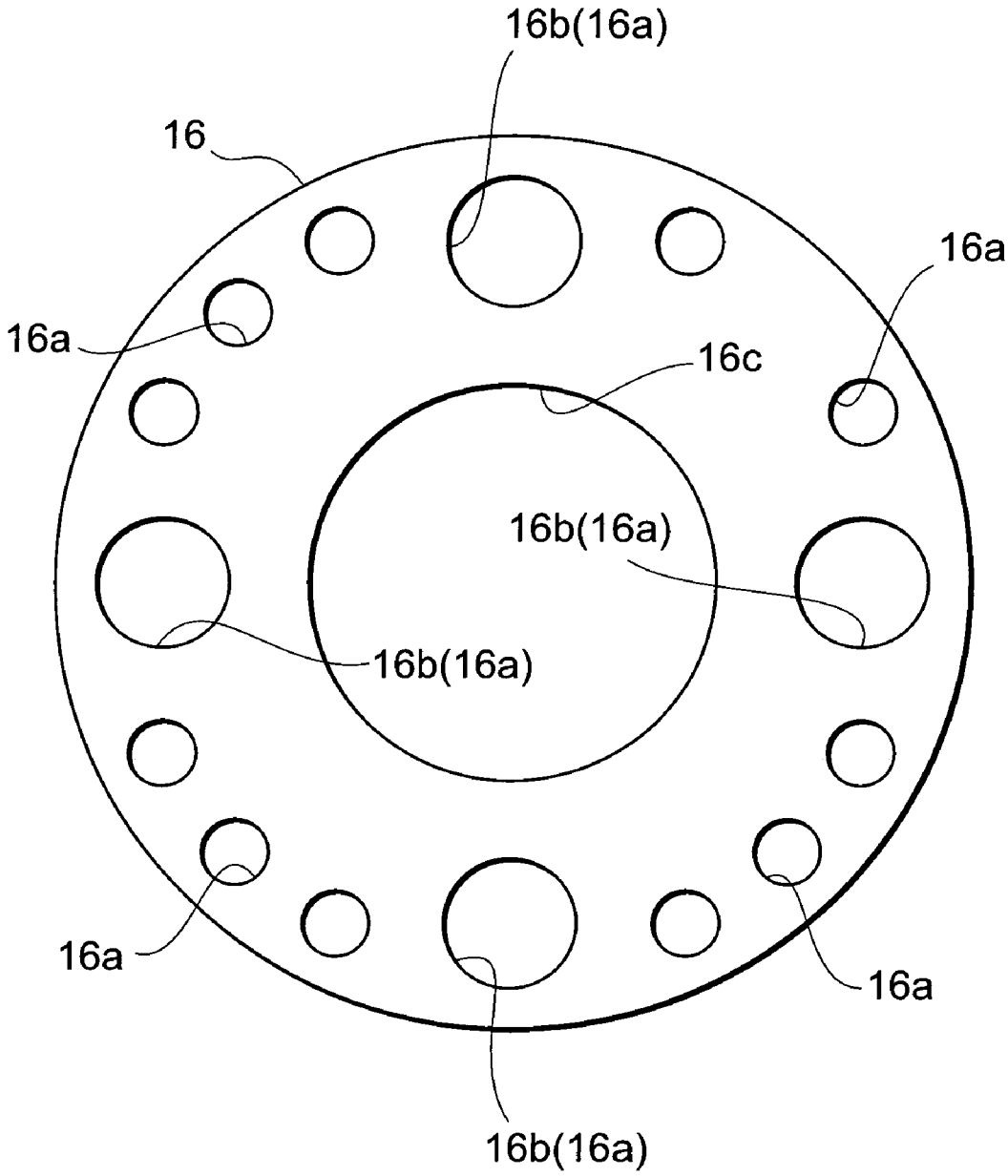
FIG. 6 is a plan view of a lower holding member.

As with the upper holding member 15, the lower holding member 16 is a disk-like member, formed of insulating glass that has been made to have a higher melting point than the base member 14, that is for example, a melting point of approximately 1100 degrees by, for example, the addition of an alumina-based powder to covar and, by the difference in the composition of the alumina-based powder added, is made to exhibit a white color and have a higher physical strength than the base member 14 and the upper holding member 15. Also as shown in FIG. 6, the lower holding member 16 has a plurality of openings 16*a* formed in the same manner as the upper holding member 15, and among the openings 16*a*, the openings of at least two predetermined locations are arranged as the large-diameter openings 16*b* to enable the entry of a positioning jig 18. In the lower holding member 16, the large-diameter openings 16*b* are positioned at four locations separated by a phase angle of 90 degrees and including that of the opening 16*a* into which the anode pin 13 is inserted, and the large-diameter openings 16*b* at the three locations besides the large-diameter opening 16*b*, through which the anode pin 13 is inserted, are positioned coaxial to the large-diameter openings 15*b* of the upper holding member 15. Furthermore, a circular base member seep opening 16*c* is formed at a central portion of the lower holding member 16.

As shown in FIG. 3, the base member 14, the upper holding member 15, and the lower holding member 16 are overlapped in a state, in which the axial center positions of the respective openings 14*a*, 15*a*, and 16*a* and large-diameter openings 15*b* and 16*b* are matched, and are joined by fusing by the melting of the base member 14 in the state in which the stem pins 6 are inserted through the respective openings 14*a*, 15*a*, 16*a*, 15*b*, and 16*b*. More specifically, the upper holding member 15 and the lower holding member 16 are joined in close contact with the respective surfaces of the base member 14, the respective stem pins 6 are inserted through the respective openings 15*a*, 16*a*, 15*b*, and 16*b* of the upper holding member 15 and the lower holding member 16 so that recesses 5*a*, having the base member 14 as the bottom surfaces, are formed along the full circumferences of the portions of both the upper (inner) surface and lower (outer) surface of the stem 5 through which the respective stem pin 6 pass, and the respective stem pins 6 are joined in close contact with the base member 14 at the bottom surfaces of these recesses 5*a*.

An example of manufacturing the stem 5, arranged in the above-described manner shall now be described with reference to FIG. 7 and FIG. 8.

Figure 7:
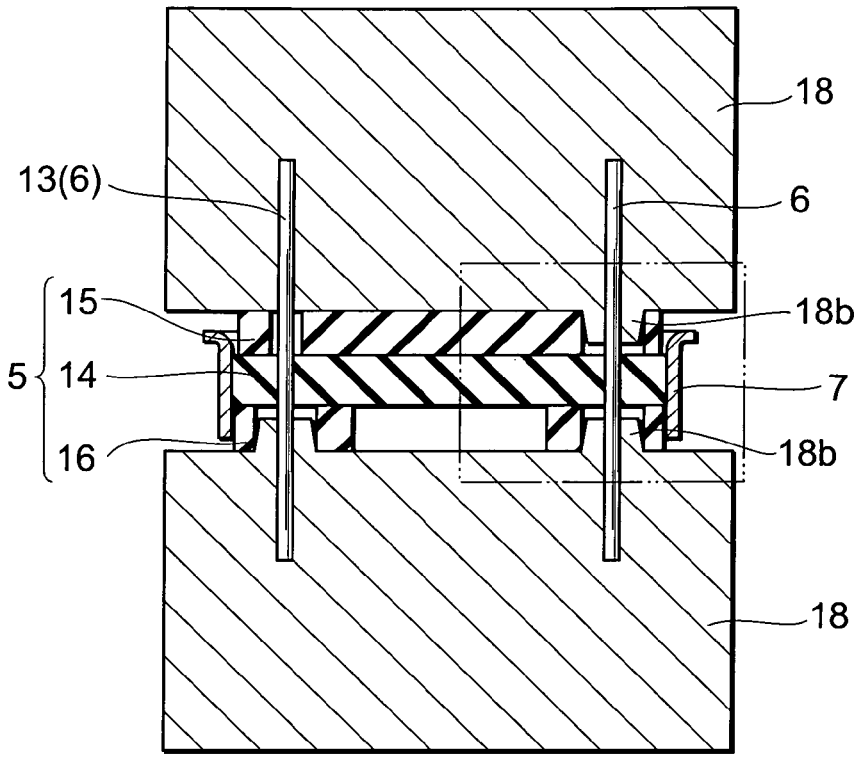
FIG. 7 shows an example of manufacturing a stem, with (a) being a sectional side view and (b) being an enlarged view of the principal portions of the stem in a state prior to sintering.
Figure 7:
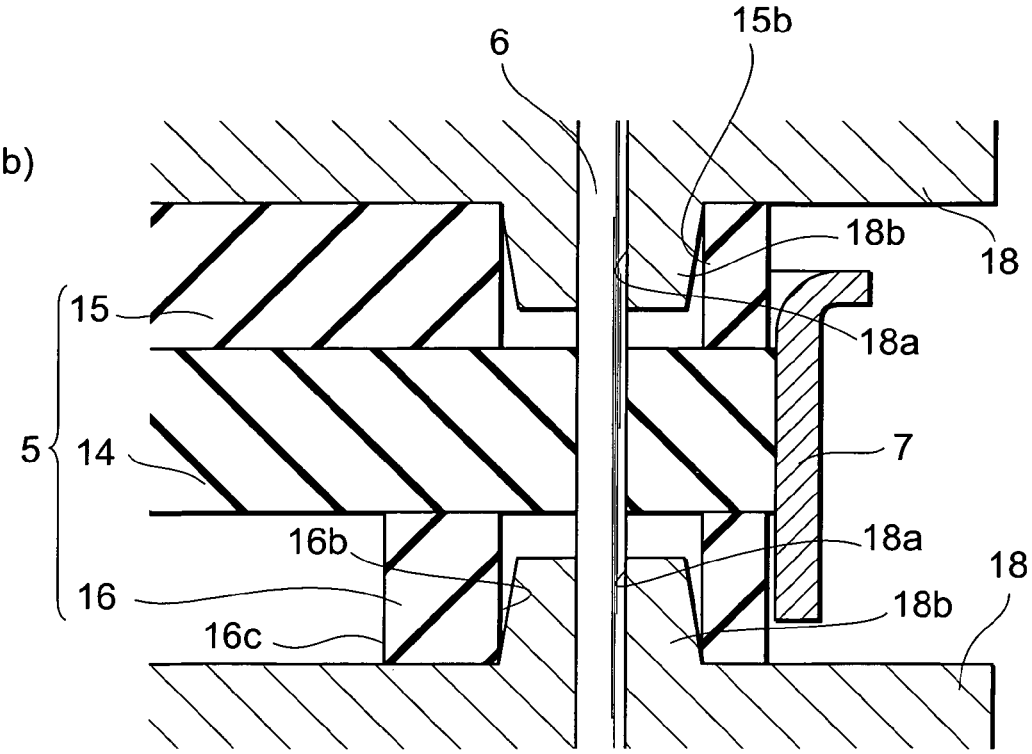
Figure 8:
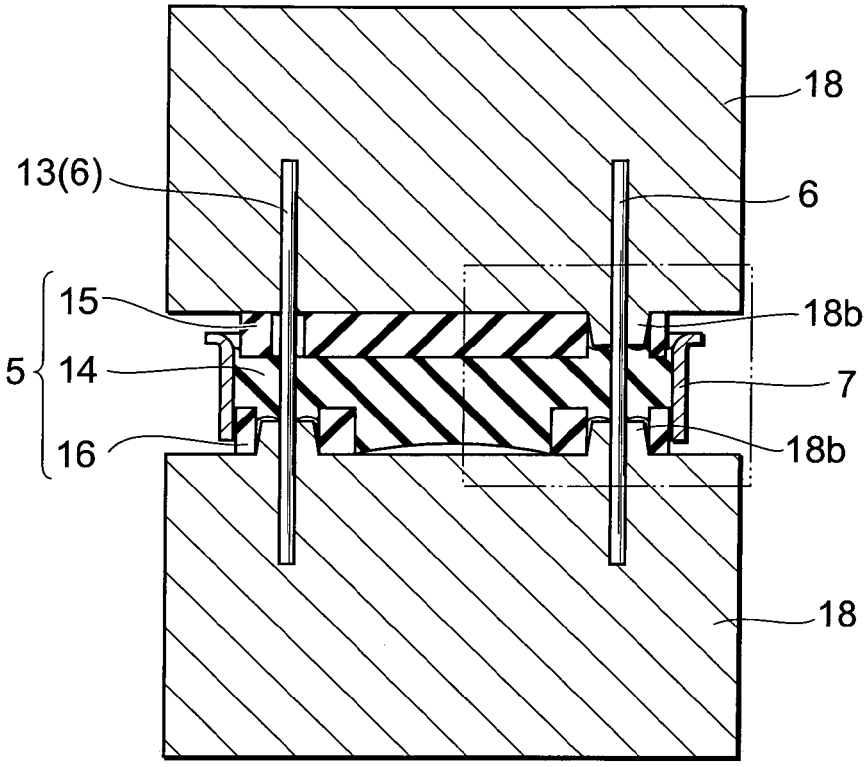
FIG. 8 shows the example of manufacturing the stem, with (a) being a sectional side view and (b) being an enlarged view of the principal portions of the stem in a state after sintering.
Figure 8:
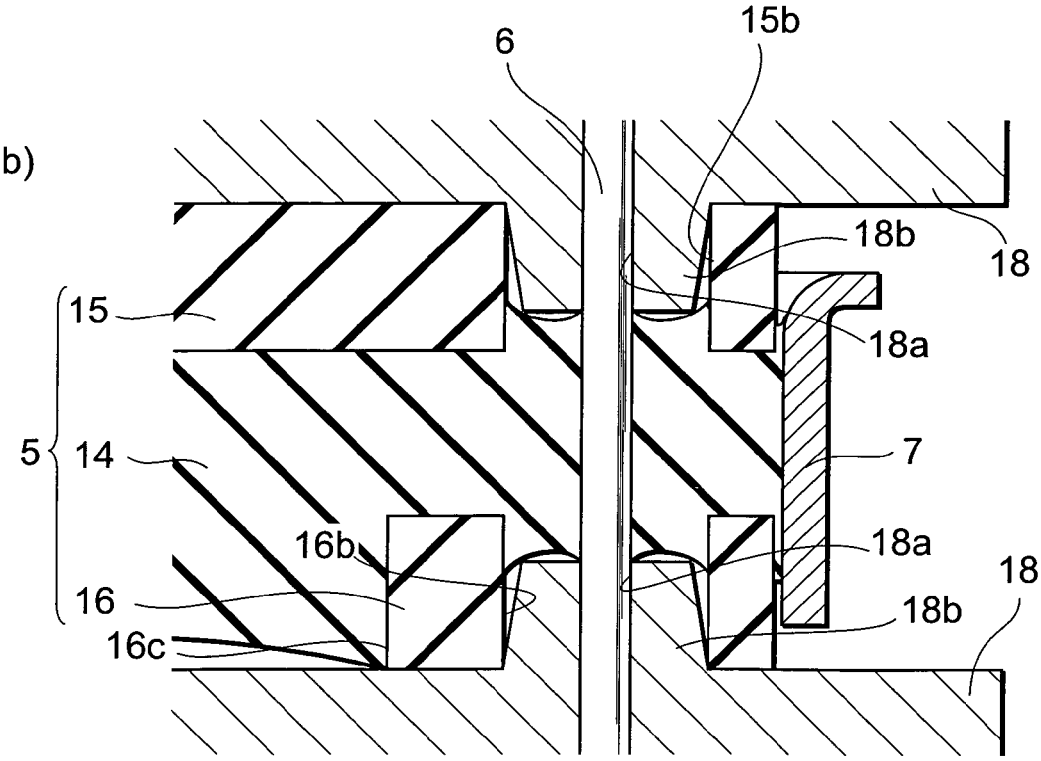

In manufacturing the stem 5, a pair of positioning jigs 18, which sandwich and hold the base member 14, the upper holding member 15, the lower holding member 16, and the respective stem pins 6 in a positioned state, are used as shown in FIG. 7(*a*) and FIG. 7(*b*).

The positioning jigs 18 are block-like members formed, for example, of highly heat resistant carbon with a melting point of no less than 1100 degrees, and at one side of each, insertion holes 18*a*, into and by which the stem pins 6 are inserted and supported, are formed in correspondence with the positions of the respective stem pins 6. At the peripheries of the openings of the insertion holes 18*a*, which, among the insertion holes 18*a*, correspond to the large-diameter opening 16*b* of the upper holding member 15 and the large-diameter opening 16*b* of the lower holding member 16, are formed substantially cylindrical protrusions 18*b*, which position the upper holding member 15 and the lower holding member 16 with respect to the base member 14 by entering inside the large-diameter openings 15*b* and 16*b* and thereby secure the concentricities of the respective stem pins 6 that pass through the base member 14 with respect to the respective openings 15*a* and 16*a*.

In setting the stem 5 using the positioning jigs 18, firstly, one positioning jig 18 (the jig at the lower side of the figure) is set, with the protrusions 18*b* facing upward, on a working surface (not shown) and the stem pins 6 are respectively inserted and fixed in the insertion holes 18*a* of this positioning jig 18. The lower holding member 16 is then set on the positioning jig 18 by making the protrusions 18*b* of the positioning jig 18 enter the large-diameter openings 16*b* while passing the respective stem pins 6, fixed to the positioning jig 18, through the openings 16*a*. Furthermore, while roughly matching the axial center positions of the respective openings 14*a* and 15*a* and the respective large-diameter openings 15*b* to the respective openings 16*a* and the large-diameter openings 16*b* of the lower holding member 16, the stem pins 6 are passed through the respective openings 14*a* and 15*a* and the respective large-diameter openings 15*b* to overlap the base member 14 and the upper holding member 15, in this order, onto the lower holding member 16, and thereafter, the ring-like side tube 7 is fitted onto the base member 14. Lastly, the other positioning jig 18 (the jig at the upper side of the figure) is set on the upper holding member 15 by making the protrusions 18*b* enter into the large-diameter openings 15*b* of the upper holding member 15 while inserting the respective stem pins 6, protruding from the upper holding member 15, into the insertion holes 18*a*. The setting of the stem 5 is thereby completed. The ring-like side tube 7 and the respective stem pins 6 that are set are subject to a surface oxidizing process in advance in order to heighten the property of fusion with the base member 14.

The stem 5, which is set thus, is then loaded inside an electric oven (not shown) along with the positioning jigs 18 and sintered at a temperature of approximately 850 to 900 degrees (a temperature that is higher than the melting point of the base member 14 but lower than the melting points of the upper holding member 15 and the lower holding member 16) while pressurizing the stem 5 sandwichingly by the positioning jigs 18. In this sintering process, just the base member 14, which has a melting point of approximately 780 degrees, melts and the base member 14 and the respective holding members 15 and 16, the base member 14 and the respective stem pins 6, and the base member 14 and the ring-like side tube 7 become fused as shown in FIG. 8(*a*) and FIG. 8(*b*). Here, although in order to achieve improved close adhesion with the other components, the volume of the base member 14 is adjusted to be somewhat high, the positioning of the base member 14 in the height direction within the large-diameter openings 15*b* and 16*b* is achieved by means of the end faces of the protrusions 18*b* of the positioning jigs 18 and the excess volume of the molten base member 14 is made to escape into the base member seep opening 16*c* of the lower holding member 16 as shown in FIG. 8(*b*). When the sintering process ends, the stem 5 is taken out from the electric oven and the upper and lower positioning jigs 18 are removed, thereby completing the manufacture of the stem 5.

With such a method of manufacturing the stem 5, since the base member 14 can be readily positioned with respect to the upper holding member 15 and the lower holding member 16 by making the protrusions 18*b* of the positioning jigs 18 enter into the large-diameter openings 15*b* of the upper holding member 15 and the large-diameter openings 16*b* of the lower holding member 16, the manufacturing process is simplified and the manufacturing cost can be reduced. Furthermore, the concentricities of the respective stem pins 6 and the respective openings 15*a* and 16*a* are secured by the positioning jigs 18. By then fixing dynodes 10, the focusing electrode 11, and the anode 12, which are layered on the inner (upper) surface of the stem 5 of the stem assembly thus obtained, welding dynode connecting tabs 10*a*, the anode connecting tabs 12*a*, and the protruding tabs 11*a*, provided on the focusing electrode 11, respectively to the corresponding stem pins 6, and fixing by welding and thereby assembling together the side tube 2, to which the light receiving plate 3 is fixed, onto the ring-like side tube 7 in a vacuum state, the photomultiplier 1 of the so-called head-on type that is shown in FIG. 1 to FIG. 3 is obtained.

With this arrangement of the photomultiplier 1, since the base member 14, through which the stem pins 6 are passed and on the respective surfaces of which holding members 15 and 16 are joined, is of the arrangement where the stem pins 6 and holding members 15 and 16 are joined by fusion by the melting of the base member 14, the positional precision, flatness, and levelness of both surfaces of the stem 5 are improved in comparison to the conventional arrangement wherein the stem 5 is a single layer of glass material and this is melted to insertingly mount the stem pins 6. Consequently with the photomultiplier 1, the positional precision of the interval between the photoelectric surface 4 and the electron multiplier unit 9, which is installed on the upper surface (inner surface) of the stem 5, and the seating property of the electron multiplier unit 9 are improved, thereby enabling photoelectric conversion efficiency and other characteristics to be obtained satisfactorily, and the dimensional precision of the total length of the photomultiplier 1 and the mounting property regarding surface mounting of the photomultiplier 1 are also improved.

Also, since the base member seep opening 16*c* (see FIG. 6) is formed in the lower holding member 16, the excess volume of the molten base member 14 can be made to escape satisfactorily into the base member seep opening 16*c*. Thus in the process of melting the base member 14, the base member 14 will not overflow onto the surface of the stem 5 via the openings 15*a* of the upper holding member 15 and the openings 16*a* of the lower holding member 16 and the positional precision, flatness, and levelness of both surfaces of the stem 5 are thus secured.

Also with the photomultiplier 1, by the respective openings 15*a* and 16*a* and the large-diameter openings 15*b* and 16*b* of the upper holding member 15 and the lower holding member 16, the full circumferences of the stem pin 6 passing portions of the upper (inner) surfaces and the lower (outer) surfaces of the openings are arranged as recesses 5*a*, having the base member 14 as the bottom surfaces. The peripheries of the portions of the base member 14 that are joined to the stem pins 6 thus become the bottom surfaces of the recesses 5*a* formed in the stem 5 so that the base member 14 is joined to the stem pins 6 at gradual angles (substantially right angles), and since even when a bending force acts on the stem pins 6, the stem pins 6 will contact the peripheral portions at the open sides of the recesses 5*a* and this will prevent further bending of the stem pins 6, cracks are prevented from being formed at both sides of the portions at which the stem pins 6 are joined to the base member 14 and airtightness and good appearance of the sealed container 8 are thus secured.

Furthermore with the photomultiplier 1, in addition to the full circumferences of the stem pin 6 passing portions of the stem 5 being arranged as described above as recesses 5*a*, having the base member 14 as the bottom surfaces, the upper holding member 15, which is the member at the upper side of the base member 14, has an insulating property. Also in the upper holding member 15, the peripheral portion near the opening 15*a*, through which the anode pin 13 is inserted, is arranged as the chamfered shape 15*c* (see FIG. 5). The actions of this arrangement shall now be described in detail using FIG. 9 and FIG. 10.

Figure 9:
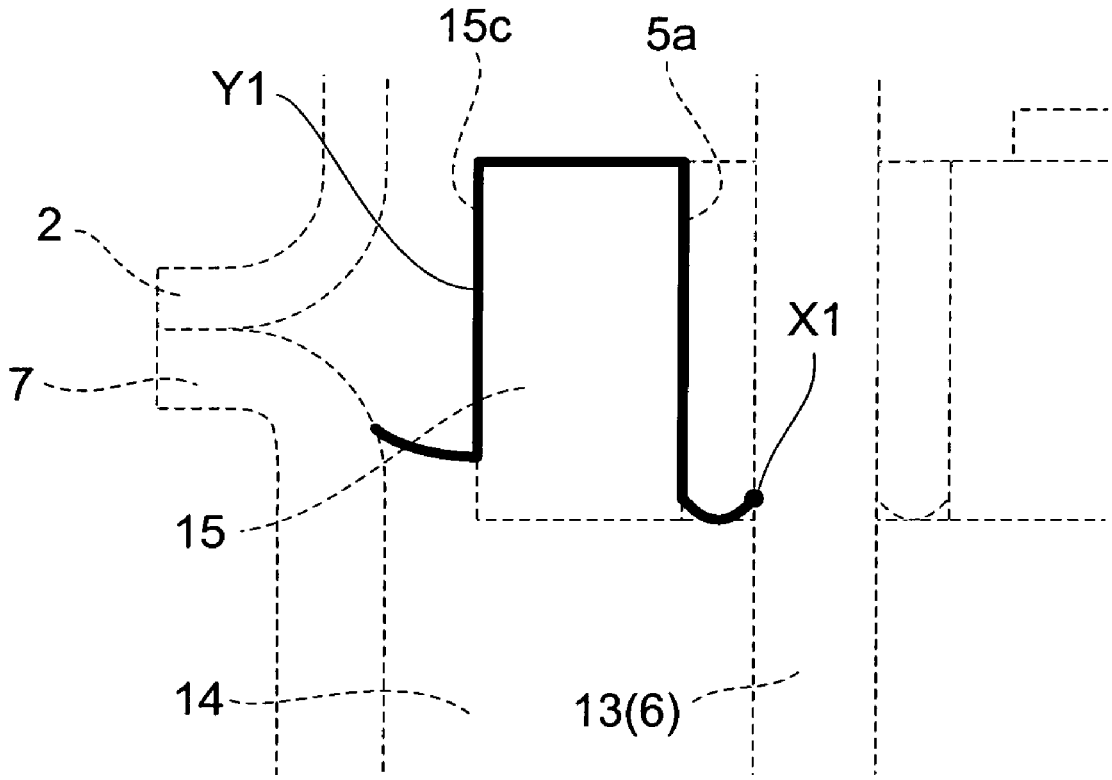
FIG. 9 is an enlarged view of the principal portions near an anode pin and shows a triple junction and the creeping distance of the photomultiplier shown in FIG. 3.
Figure 10:
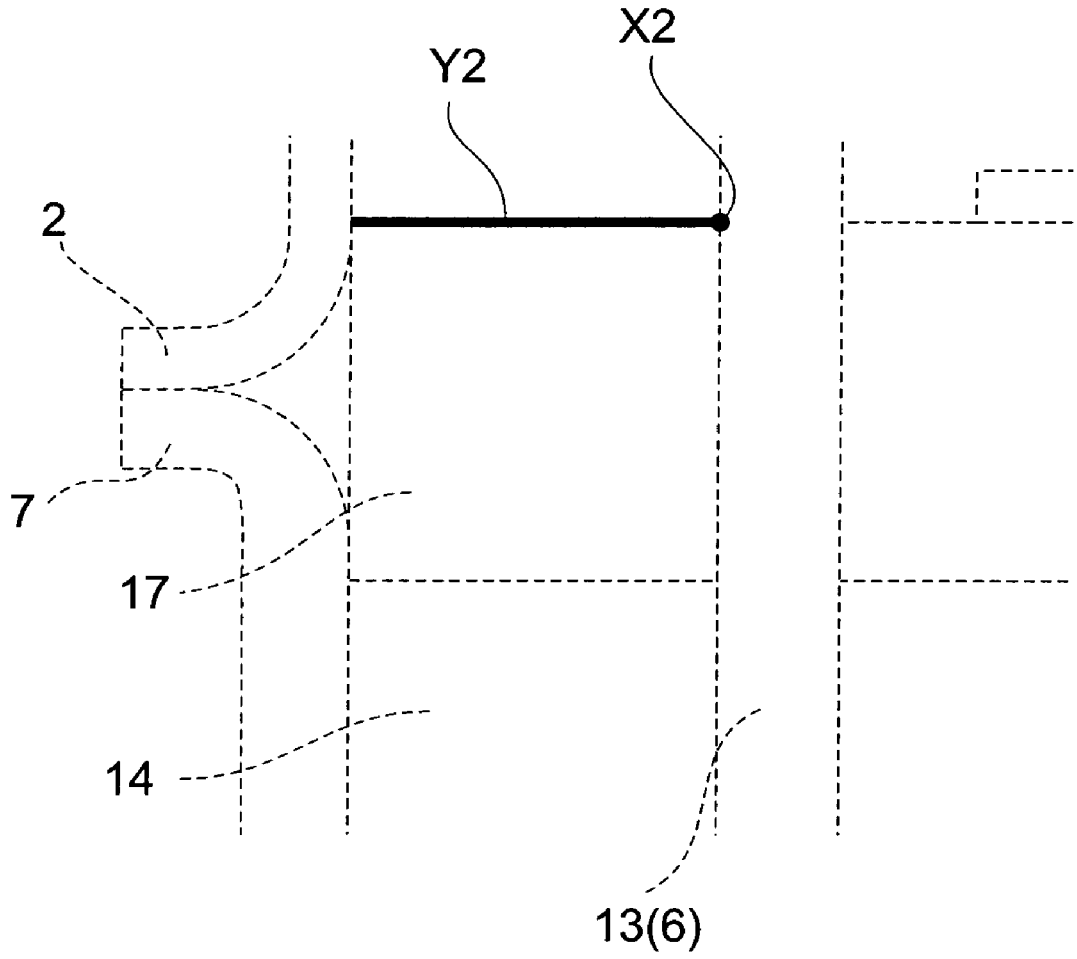
FIG. 10 is an enlarged view of the principal portions near an anode pin and shows a triple junction and the creeping distance of a comparative example.

FIG. 9 is an enlarged sectional view of the principal portions near the anode pin 13 of the present embodiment and FIG. 10 is an enlarged sectional view of the principal portions near the anode pin 13 of a comparative example. In the comparative example, the recesses 5*a* are not formed at portions of the stem 5 through which the stem pins 6, including the anode pin 13, are passed, and an upper holding member 17, in which the chamfered shape 15*c* is not formed near the anode pin 13, is used. For the sake of description, the respective members are indicated by broken lines.

As shown in FIG. 9, with the present embodiment, since the full circumferences of the portions of the stem 5, through which the stem pins 6, including the anode pin 13, pass, are formed as recesses 5*a*, having the base member 14 as the bottom surfaces, triple junctions X1, at which any of the conductive stem pins 6, including the anode pin 13, insulating the base member 14, joined to the stem pins 6 including the anode pin 13, and vacuum intersect, are positioned at peripheral portions of the junctions of the bottom surface of the recess 5*a* of the stem 5 with the stem pins 6 including the anode pin 13 and are put in concealed-like states inside the recesses 5*a*. By thus concealing triple junctions X1 inside the recesses 5*a*, the occurrence of creeping discharge is restrained and the voltage endurance of the photomultiplier 1 is improved in comparison to the case where the triple junctions are put in bare states on the upper surface of the upper holding member 17 as is the case with triple junctions X2 of the comparative example shown in FIG. 10. In regard to the concealing of triple junctions X1 by the recesses 5*a*, the upper holding member 15, which is a member positioned above the base member 14, may be conductive.

Also, the creeping distance Y1 along insulators from a triple junction X1 to the ring-like side tube 7 is elongated by an amount corresponding to the height of the recess 5*a* in comparison to the creeping distance Y2 along insulators from a triple junction X2 to the side tube 2 in the comparative example shown in FIG. 10. By thus elongating the creeping distance Y1, the occurrence of creeping discharge is restrained further and the voltage endurance of the photomultiplier 1 is improved further. By the forming of the recess 5*a*, the creeping distances along insulators between the stem pins 6 are elongated at the same time and the voltage endurance of the photomultiplier 1 is thereby improved further. Furthermore in regard to the vicinity of the anode pin 13, since the creeping distance Y1 is elongated especially by the distance along the chamfered shape 15*c* of the upper holding member 15, dielectric breakdown and current leakage caused by creeping discharge in the vicinity of the anode pin 13 are prevented more definitely and the mixing of noise into the electrical signal taken out from the anode pin 13 is prevented.

Since the concentricities of the respective stem pins 6 and the respective openings 15*a* of the upper holding member 15 and the respective openings 16*a* of the lower holding member 16 are secured by the positioning jigs 18, the stem pins 6 can be prevented from approaching the inner wall surfaces of the openings 15*a* and 16*a*. Triple junctions X1 can thus be concealed definitely inside the recesses 5*a* and the voltage endurance of the photomultiplier 1 is thus secured further.

This invention is not restricted to the above-described embodiment. For example, other layers may be provided further on the upper surface of the upper holding member 15 to make the entirety of the stem 5 four layers or more and the electron multiplier unit 9 may be installed on the upper surface of such other layers. In this case, an arrangement is preferably employed wherein each of the other layers is provided with a plurality of openings for insertion of the stem pins 6 joined to the base member 14 in the same manner as in the upper holding member 15 and at least two of these openings are made larger in diameter than the other openings in order to enable the entry of the positioning jigs 18 into the base member 14.

Also, although with the above-described embodiment, the base member seep opening 16*c* is provided only in the lower holding member 16, it is sufficient that such a base member seep opening be provided in at least one of the holding members, and for example, a base member seep opening may be provided in just the upper holding member 15 or base member seep openings may be provided in both the upper holding member 15 and the lower holding member 16.

Also, though with the above-described embodiment, an insulating glass is used as the upper holding member 15, as long as the upper holding member 15 and dynode 10*b* can be electrically insulated, the material of the layers to be joined to the respective surfaces of the base member 14 may be a metal or a metal-containing material, even in cases where the stem 5 is arranged with four or more layers. Although the creeping distance will be shortened somewhat in this case, the positional precision, flatness, and levelness of both surfaces of the stem 5 will be secured adequately. Furthermore, from the standpoint of securing the positional precision, flatness, and levelness of both surfaces of the stem 5, the stem pins 6 do not necessarily have to be passed through the respective holding members 15 and 16 or in the other layers used in arrangements of four or more layers.

Figure 11:
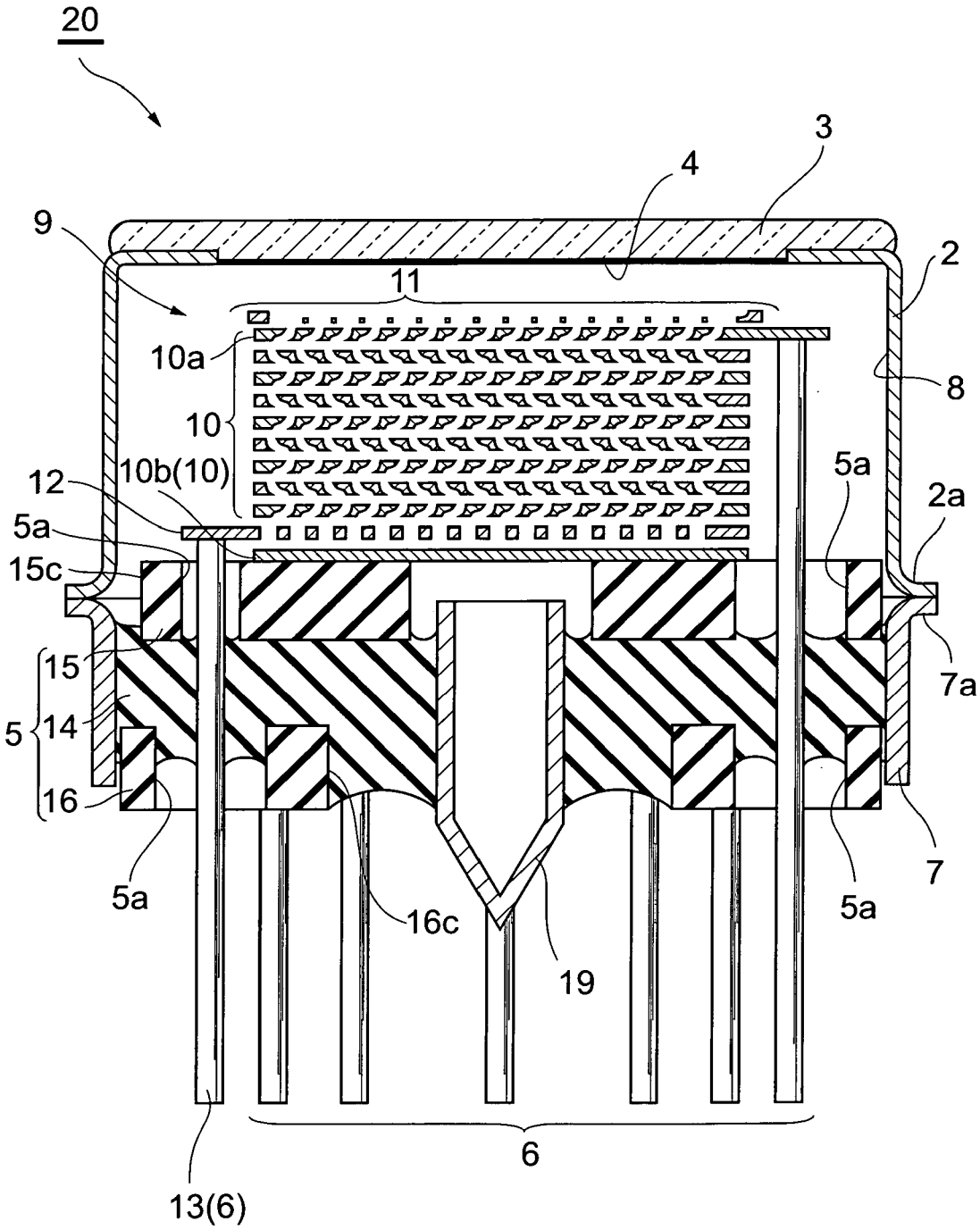
FIG. 11 is a sectional side view of a photomultiplier of a modification example.
Figure 12:
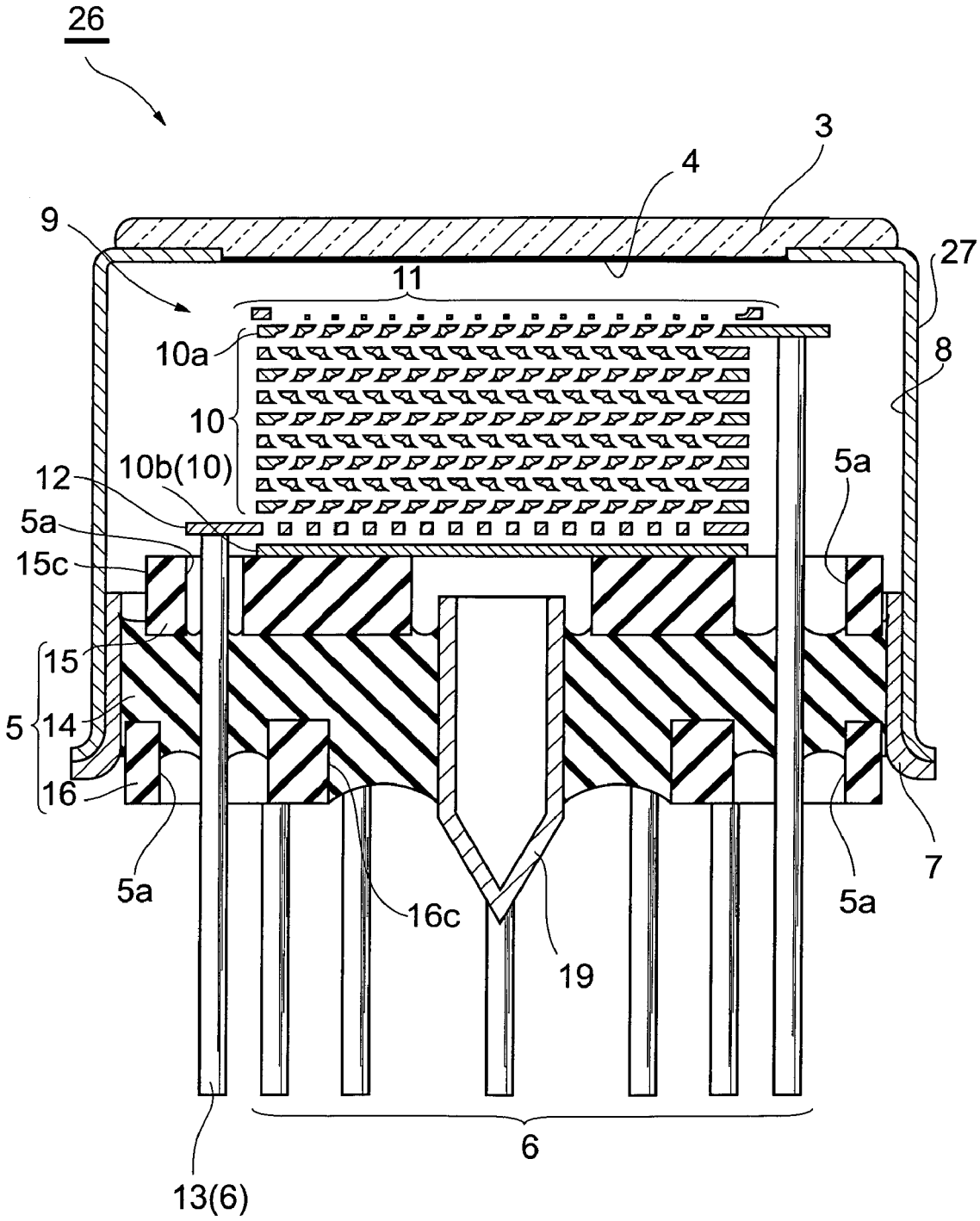
FIG. 12 is a sectional side view of a photomultiplier of another modification example.

As a modification example of the present embodiment, a photomultiplier tube 20, having a metal exhaust tube 19 disposed at a central portion of the stem 5 as shown in FIG. 11, may be employed. This exhaust tube 19 can be used to exhaust air by a vacuum pump (not shown), etc., and put the interior of the sealed container 8 in a vacuum state after completion of assembly of the photomultiplier 20. As yet another modification example, a photomultiplier 26 may be employed that has an arrangement, wherein a side tube 27, which is longer in length than the side tube 2, is fitted to the ring-like side tube 7, provided with a flange portion at its lower end, and the flange portions of the side tubes are fixed together by welding as shown in FIG. 12.

Figure 13:
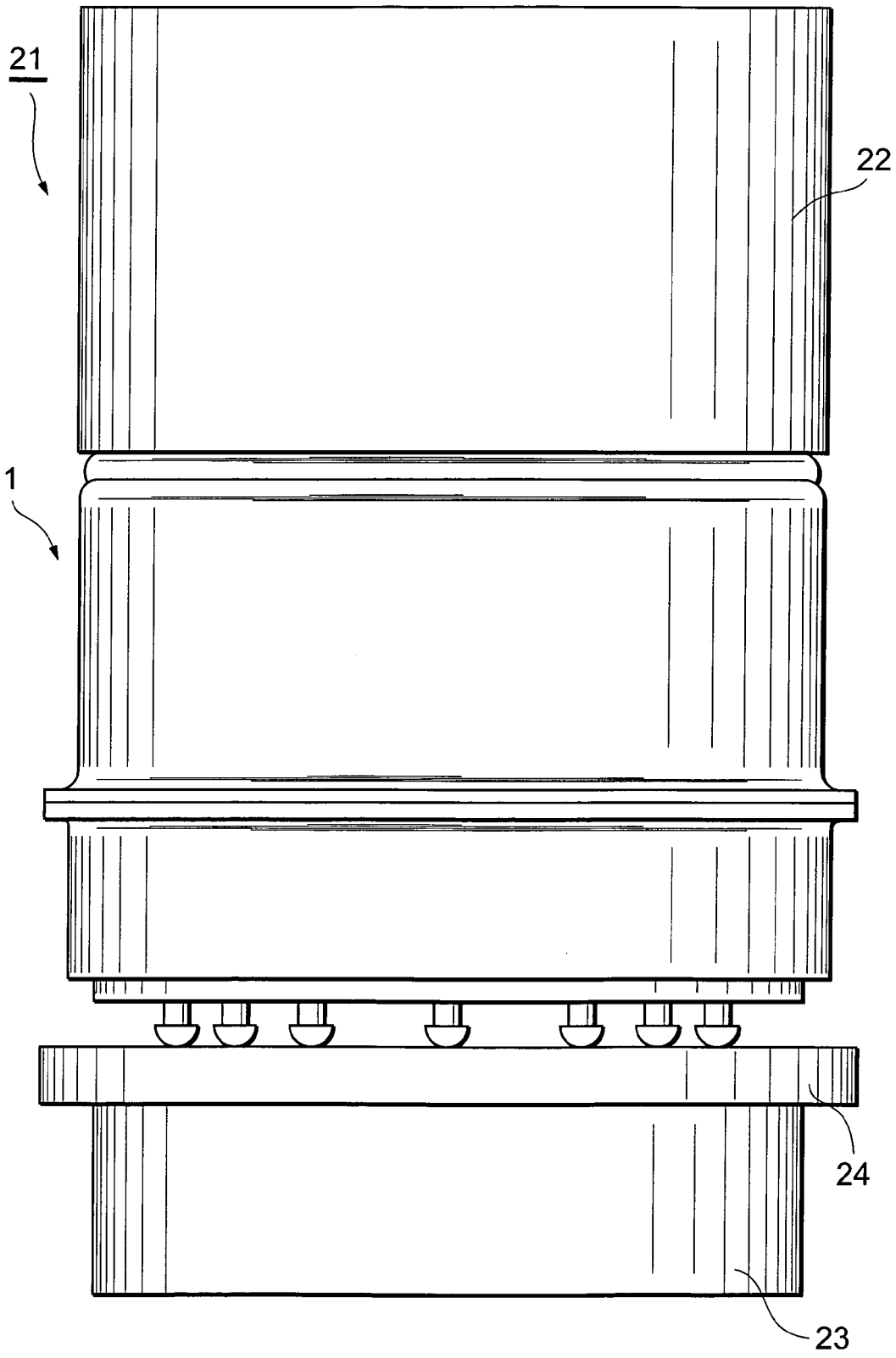
FIG. 13 is a sectional side view of an example of a radiation detector.
Figure 14:
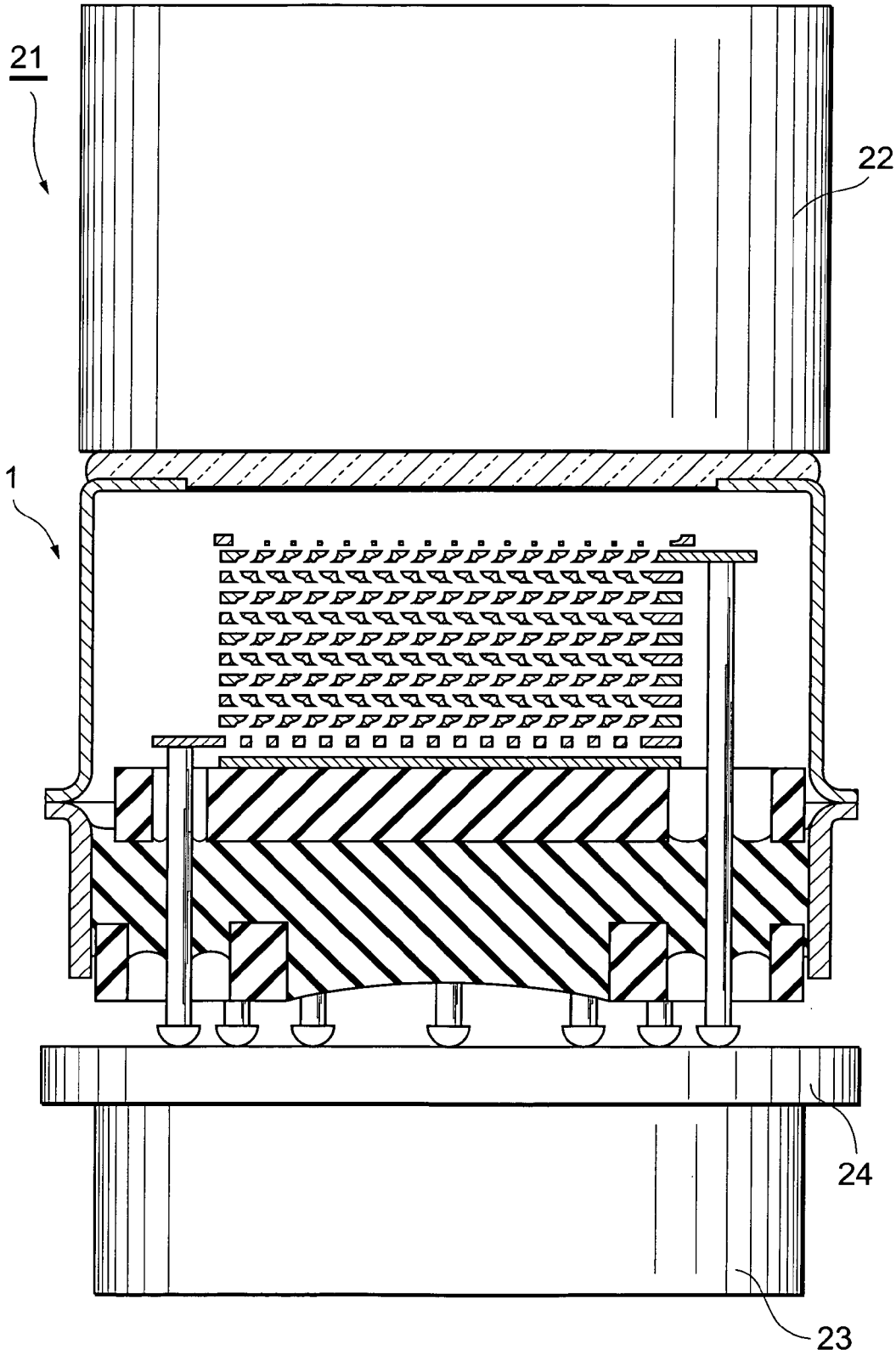
FIG. 14 is a sectional view of the principal portions of the radiation detector shown in FIG. 13.
Figure 15:
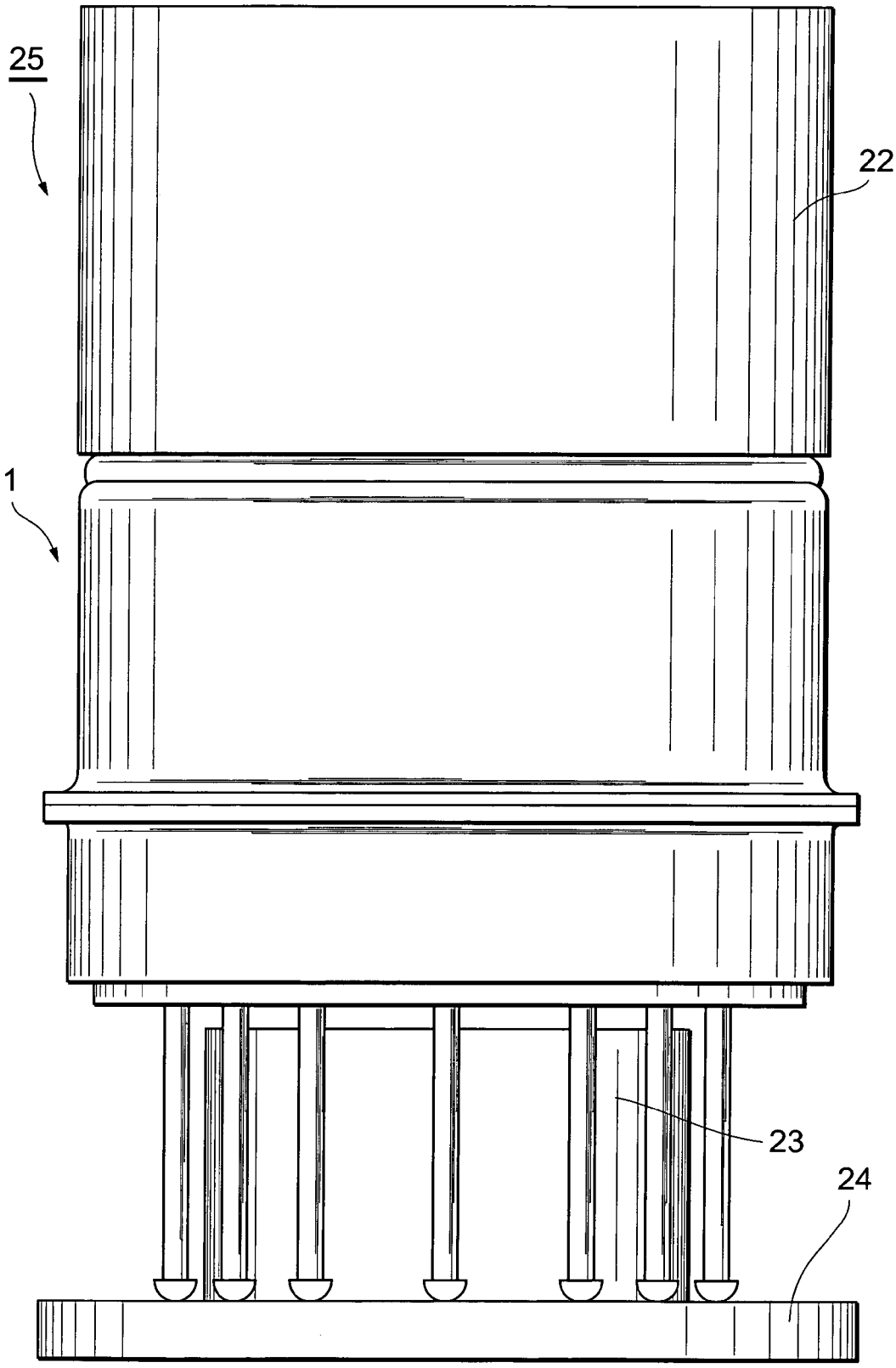
FIG. 15 is a sectional side view of another example of a radiation detector.
Figure 16:
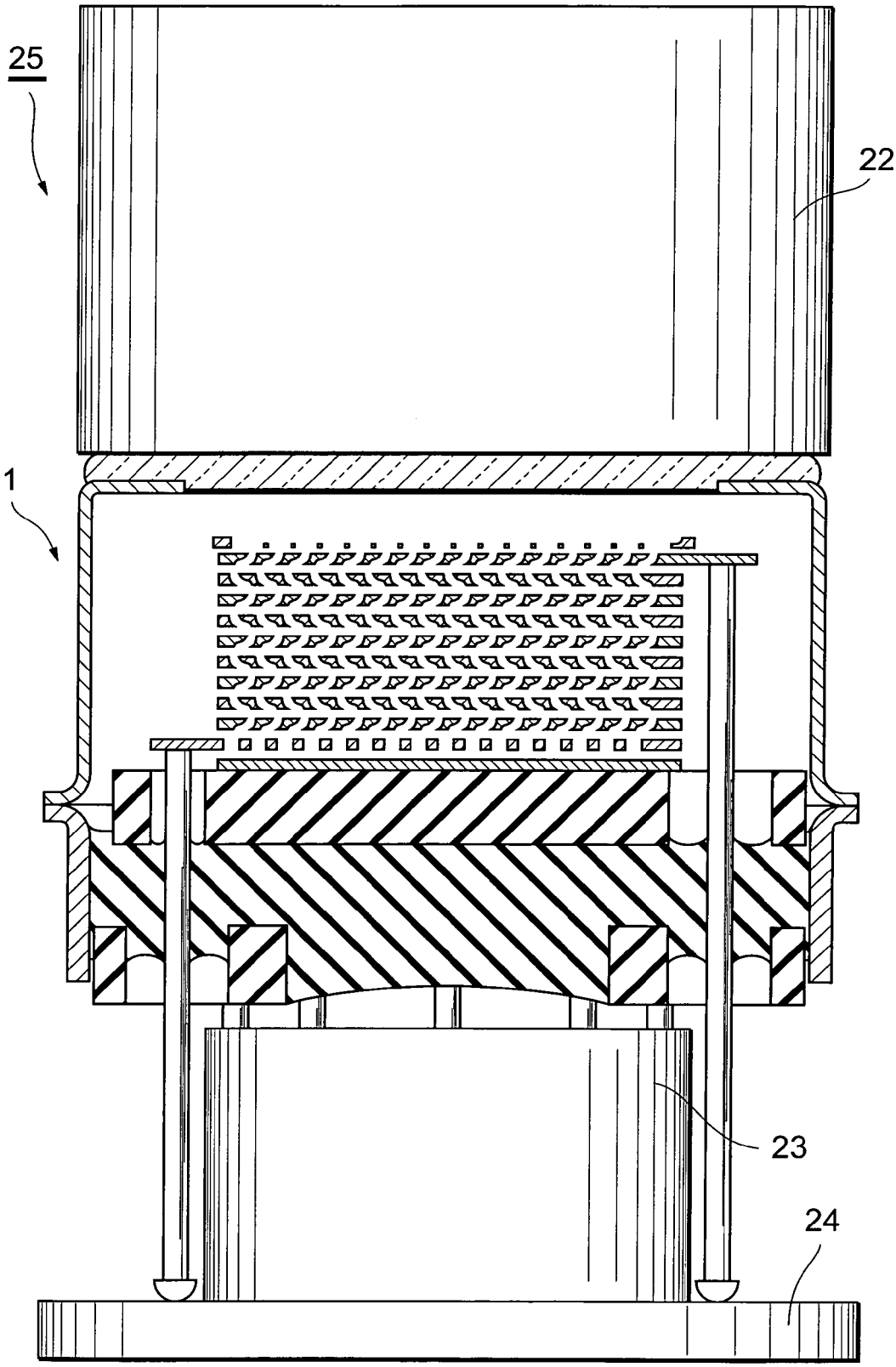
FIG. 16 is a sectional view of the principal portions of the radiation detector shown in FIG. 15.

Examples of a radiation detector equipped with the photomultiplier 1 shown in FIG. 1 to FIG. 3 shall now be described. With a radiation detector 21 of the example shown in FIG. 13 and FIG. 14, a scintillator 22, which converts radiation into light and emits the light, is installed at the outer side of the light receiving plate 3 of the photomultiplier 1 and the photomultiplier 1 is mounted onto a circuit board 24, having a processing circuit 23 at the lower surface side. With a radiation detector 25 of another example shown in FIG. 15 and FIG. 16, processing circuit 23 is installed above circuit board 24, and the photomultiplier 1 is mounted onto circuit board 24 in a manner such that the stem pins 6 surround processing circuit 23. By these arrangements, the radiation detectors 21 and 25, which exhibit the above-described actions and effects and are especially suitable for surface mounting, can be provided. That is, since with the photomultiplier 1, the stem 5 is arranged with at least three or more layers formed by sandwiching the base member 14 with holding members 15 and 16, the flatness and levelness of the lower surface (outer surface) of the stem 5 and the dimensional precision of the total length of the photomultiplier 1 are improved, thus improving the mounting property regarding surface mounting onto processing circuit 23 or circuit board 24 and enabling favorable mounting without the use of sockets and other members. Mounting with the lower surface (outer surface) of the stem 5 being set close to the surface of processing circuit 23 or circuit board 24 and alleviation of the trouble of adjusting the height position of the radiation detector 21 or 25, including the photomultiplier 1, in the process of mounting are thus enabled.

As described above, with the present invention's photomultiplier and radiation detector, predetermined characteristics can be obtained and the seating property of the electron multiplier unit, the dimensional precision of the total length of the photomultiplier, and the mounting property regarding surface mounting of the photomultiplier can be improved.

What is claimed is:

1. A photomultiplier comprising:

a photoelectric surface disposed inside a sealed container, which is put in a vacuum state, and converting incident light made incident through a light receiving plate into electrons, which forms an end portion at one side of the sealed container;

an electron multiplier unit disposed inside the sealed container and multiplying electrons emitted from the photoelectric surface;

an anode disposed inside the sealed container and used for taking out the electrons multiplied by the electron multiplier unit as an output signal;

a stem forming an end portion at the other side of the sealed container and having a base member, with an insulating property, and holding members, having a melting point higher than that of the base member and being joined respectively to an inner surface and an outer surface of the base member; and a plurality of stem pins insertedly mounted in the stem and leading to the exterior from inside the sealed container and electrically connected to the anode and the electron multiplier unit, wherein the stem pins are passed through and joined to the base member, and the electron multiplier unit and the anode are layered on the inner surface of the stem, and the base member and the holding members, and the base member and the stem pins are respectively joined by fusion by the melting of the base member.

2. The photomultiplier according to claim 1, wherein the holding members have a plurality of openings, through which the stem pins joined to the base member are inserted, and at least two of the openings are made larger in diameter than the other openings.

3. The photomultiplier according to claim 1, wherein at least one of the holding members is provided with a base member seep opening, into which the base member seeps upon melting.

4. The photomultiplier according to claim 1, wherein the holding members joined to the inner and outer surfaces have respective pluralities of openings through which the stem pins joined to the base member are inserted, and the base member defines respective bottom surfaces with respect to the pluralities of openings.

5. The photomultiplier according to claim 4, further comprising a conductive side tube that partially forms the sealed container and that surrounds the stem from the side, and wherein the holding members joined at the inner surface of the base member have an insulating property.

6. A radiation detector comprising:

a photomultiplier including:

a photoelectric surface disposed inside a sealed container, which is put in a vacuum state, and converting incident light made incident through a light receiving plate into electrons, which forms an end portion at one side of the sealed container;

an electron multiplier unit disposed inside the sealed container and multiplying electrons emitted from the photoelectric surface;

an anode disposed inside the sealed container and used for taking out the electrons multiplied by the electron multiplier unit as an output signal;

a stem forming an end portion at the other side of the sealed container and having a base member, with an insulating property, and holding members, having a melting point higher than that of the base member and being joined respectively to an inner surface and an outer surface of the base member;

and a plurality of stem pins insertedly mounted in the stem and leading to the exterior from inside the sealed container and electrically connected to the anode and the electron multiplier unit, wherein the stem pins are passed through and joined to the base member, and the electron multiplier unit and the anode are layered on the inner surface of the stem, and the base member and the holding members, and the base member and the stem pins are respectively joined by fusion by the melting of the base member; and a scintillator, converting radiation into light and emitting the light, installed at the outer side of the light receiving plate of the photomultiplier.

* * * * *